United States Patent [19]

Kawamoto et al.

[11] 3,943,469

[45] Mar. 9, 1976

[54] MECHANICAL STRUCTURE FOR MOUNTING MICROWAVE DIODE PACKAGES

[75] Inventors: Hirohisa Kawamoto, Kendall Park, N.J.; Elmer Lawrence Allen, Jr., Philadelphia, Pa.

[73] Assignee: RCA Corporation, New York, N.Y.

[22] Filed: Nov. 25, 1974

[21] Appl. No.: 527,056

[52] U.S. Cl. ..... 333/84 M; 357/74; 357/79

[51] Int. Cl.[2] ..... H01P 1/00

[58] Field of Search ..... 357/74, 79; 333/84 M; 317/101 CP, 101 A

[56] References Cited

UNITED STATES PATENTS 3,731,160 5/1973 Klein ..... 333/84 M X 3,801,882 4/1974 Ward ..... 333/84 M X

*Primary Examiner*—Paul L. Gensler

*Attorney, Agent, or Firm*—Edward J. Norton; Joseph D. Lazar; Michael A. Lechter

[57] ABSTRACT

A mount for a microwave diode package wherein good thermal contacts, as well as radio frequency contacts to a microstrip circuit are achieved by applying a mechanical force to a face of the mount at an acute angle so that forces are produced along both of the major axes of the mount.

5 Claims, 3 Drawing Figures

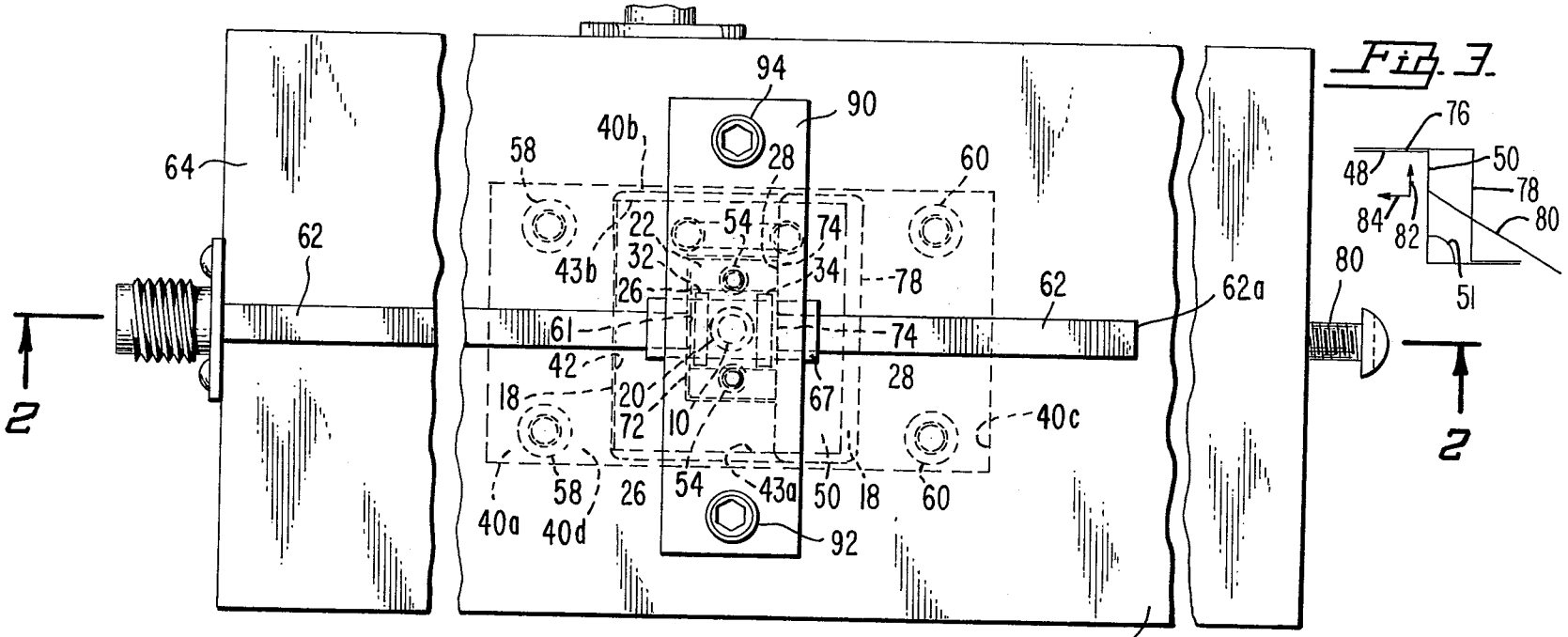
Fig. 1.
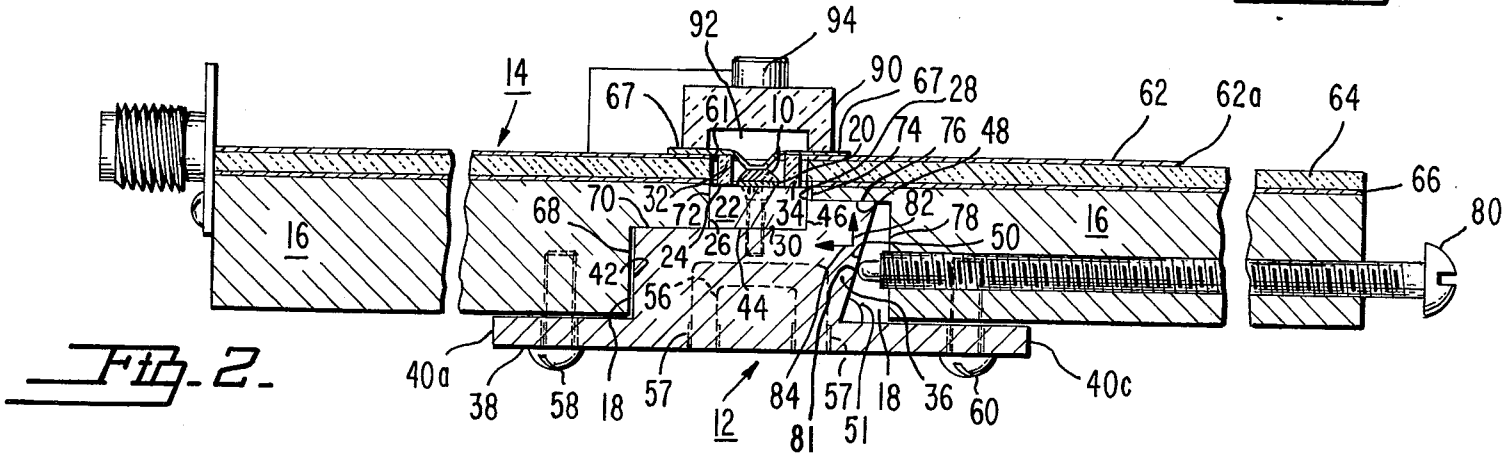
Fig. 2.
Fig. 3.

MECHANICAL STRUCTURE FOR MOUNTING MICROWAVE DIODE PACKAGES

The invention herein disclosed was made in the course of or under a contract or subcontract thereunder with the Department of the Air Force.

BACKGROUND OF THE INVENTION

1. Field of the Invention

The present invention relates to mechanical structures for mounting a mcirowave device such as a diode in a microstrip line circuit.

2. Description of the Prior Art

The generation of high power microwave output signals by microwave devices such as diodes requires adequate dissipation of heat generated by such devices at, for instance, the diode junction. Thus, in order to increase the power handling capability of a diode, the diode is mounted in intimate thermal contact with a heat sink. Adequate dissipation of heat, achieved as indicated above by "heat sinking," is especially important in those applications where the diode is in high power, long pulse and high duty cycle operation.

A generally applied technique for heat dissipation consists of "flip-chip" bonding, in which one surface of a diode is brought in contact with a heat sink through a process known as "thermal compression." While such a technique is effective for diodes having very small diameters, surface finishing (smoothing) techniques for larger areas (500 micrometers) are generally so inadequate as to result in poor thermal contact, which consequently renders flip-chip bonding inadequate for larger (500 micrometers) diameter diodes such as power diodes. Such large diameter diodes utilize an integral copper heat spreader which is created by electroplating a heavy copper layer to a given surface of the diode. The electroplated diode side may typically serve also as an electrical terminal. A detailed description of the formation of the integral heat spreaders may be found in an RCA Laboratories Report PRRL-72-CR-37 entitled "S-Band avalanche Diode Amplifiers," by H. Kawamoto, H. J. Prager, et al. published July 31, 1972.

Microwave stripline (microstrip) circuits are typically constructed from commercially available laminates consisting of a sheet of insulation initially provided on both sides with layers of a suitable conductive material such as copper. Portions of one of the conductive layers are removed, suitably by etching, to form a stripline conductor. The second conductive layer, on the other side of the sheet of insulation, is suitably left intact and forms the ground plane (second conductor) of the microstrip circuit. The microstrip circuit is typically mounted on a metallic, conductive base or chassis, with the ground plane of the circuit in contiguous contact with the conductive base.

The use of integral heat spreaders, and the finite life of diodes require that the diodes by removably connected in the microstrip circuit. Typically, the diode is mounted in a conductive package fabricated separately from the conductive base, prior to insertion of the diode into the microstrip circuit, and the package subsequently mounted in the base. The diode is then electrically connected to the strip line circuit. The package is suitably formed of a material having good thermal and electrical conductivity such as copper. Generally, such mounting is achieved by machining in the base a recess of a given shape, typically a pyramid of two rectilinear parallelpipeds, diminishing in size, such that the smaller one is exposed to the ground plane of the microstrip circuit. An aperture in the microstrip circuit is made in alignment with the opening in the base facing the recess. The diode and integral heat spreader are mounted, suitably by soldering, on the package of conductive material, which serves, in conjunction with the base, as a heat sink. The package is of such a shape as to fit in, mate with, and extend through the recess in the baseplate. The diode is admitted through the aperture in the circuit board and is electrically connected to the microstrip line by a metallic, suitably gold, foil. Electrical connection between the diode and the ground plane is established by the contact of the package with the base.

The package may be flanged and fastened to the base by screws passing through the flange and into the base. Electrical and thermal contact between the base and package is enhanced by torqueing the screws, thereby creating a force on the package in a vertical direction. The horizontal surfaces of the package are thus pressed against the respectively adjacent surface portions of the base.

The above described mounting structures are generally unsatisfactory in that machine tolerances generally do not provide reliable mating of the package to the base, and, consequently gaps occur between the vertical sidewalls of the package an the base. Such gaps, at microwave frequencies often form resonant cavities and create parasitic capacitance and inductance, having the effect of detuning the circuit. The RF power output, DC to RF efficiency, and bandwidth of the circuit are thus adversely affected.

The present invention overcomes the disadvantages of the prior art by providing a microwave diode package and mounting structure which serves to provide reliable mating of the package to the recess whereby electrical and intimate thermal contact is established between the package and the base, substantially eliminating gaps, between adjacent vertical surfaces. Thus parasitic capacitance and inductance are substantially reduced, causing a substantial increase in bandwidth, and RF power output of the circuit.

SUMMARY OF THE INVENTION

The present invention provides an apparatus for mounting a device in a stripline circuit of the type having a dielectric substrate with a ground plane conductor on one surface thereof and a narrow strip-like conductor on the opposite surface of the substrate, the circuit having an aperture for receiving the device in a position to allow for electrical connections to the strip-like conductor.

A first block of electrically and thermally conductive material is mounted in contiguous relation with the ground plane to provide an electrical ground to the circuit and to conduct heat from the circuit. The first block is provided with an opening for receiving a second block, the opening being defined by a plurality of surfaces formed in the first block.

The second block is formed of electrically and thermally conductive material and includes a surface portion for mounting the device. Additional surfaces of the second block are adapted to mate substantially with the surfaces of the opening.

The device is mounted on the surface portion of the second block, with one terminal of the device being electrically and thermally connected to the surface portion.

Means are included for forcing the second block into close mating relation with the first block whereby the surfaces of the opening are pressed into good thermal and electrical contact with the corresponding surfaces of the second block.

The forcing means include an adjustable force producing member, adapted to apply a force to one surface of the second block to adjustably force the second block into the first block along two major axes of the respective blocks, the angle of the force relative to the one surface being an acute angle.

BRIEF DESCRIPTION OF THE DRAWING

FIG. 1 shows a plane view of a microwave diode package and mounting structure in accordance with the present invention;

FIG. 2 is a sectional view of the structure of FIG. 1 taken along Line 2—2;

FIG. 3 is a schematic illustration of an alternative embodiment of the present invention.

DETAILED DESCRIPTION OF THE PREFERRED EMBODIMENT

Referring to the drawing, comprising FIGS. 1 and 2, there is generally shown a microwave diode 10 mounted on a package generally referred to as 12, and connected in a microstrip circuit 14. Microstrip circuit 14 is mounted on a conductive base 16 which has a recess or opening 18 in which package 12 is fit.

Diode 10 is suitably a higher power trapatt diode having a heavy copper layer 20 which may be electroplated on one side of the diode to serve both as a integral heat spreader and as a terminal for the diode.

A more detailed description of package 12 is as follows. Diode 10 is mounted on a conductive pedestal 22, suitably a solid block of copper having an upper surface 24, end walls 26 and 28 and lower surface 30. Specifically, layer 20 is suitably mounted in intimate electrical and thermal contact with top surface 24 of pedestal 22 as by soldering. Also mounted on surface 24 of pedestal 22 are lead supports 32 and 34, suitably rectangular pieces of an insulating material such as alumina or beryllia. Supports 32 and 34 are spaced on surface 24 such that diode 10 and layer 20 may be mounted therebetween.

Pedestal 22 is affixed to a mounting block serving also as a heat sink, generally indicated as 36, having, in accordance with the present invention, one diagonal sidewall 50 which is formed at an angle 51 less than 90° with respect to the ground plane in the direction as indicated in FIG. 2. Block 36 is formed of a lower surface 38 extended into flanges 40 *a–d*, endwall 42, sidewalls 43*a* and 43*b*, surface 44, endwall 46, surface 48, and diagonal endwall 50. Pedestal 22 is mounted on mounting block 36 such that its surfaces 30 and 28 respectively abut surfaces 44 and 46 of mounting block 36. Pedestal 22 is affixed to mounting block 36 such that surface 30 of pedestal 22 and surface 44 of mounting block 36 are forced into intimate thermal and electrical contact, suitably by a pair of torqued screws, generally indicated as 54, suitably set in countersunk holes in pedestal 22. Mounting block 36 is formed of a rigid, thermally and electrically conductive substance such as copper or brass and may be water cooled as by circulating coolant through a channel 56 suitably coupled as by threads 57 to an external coolant source, not shown. It will be apparent to those skilled in the art that mounting block 36 and pedestal 22, may, in the alternative, be formed as an integral unit.

Mircrostrip circuit 14 is provided with an aperture 61 for receiving diode 10 and further comprises a microstrip line 62, an insulation substrate 64 and a conductive ground plane 66. Aperture 61 in microstrip circuit 14 may be just large enough to receive diode 10 and lead supports 32 and 34 and as such be of a lesser area than surface 24 of pedestal 22. One terminal of diode 10 is electrically connected to microstrip line 62 by a conductive foil 67 typically gold and at the other diode terminal (layer 20, mentioned above) to the ground plane 66 by contact of package 12 to base 16, as will be explained.

As previously noted, ground plane 66 of microstrip circuit 14 is in contiguous contact with conductive base 16, which is formed to support microstrip circuit 14 and to receive package 12. Base 16 is suitably a rigid structure made of material with good electrical and thermal conductivity, such as copper or brass.

As previously noted, package 12 fits into base 16. Opening 18 of base 16 is configured to receive package 12 such that the upper surface 24 of package 12 is in same plane as the top surface of base 16 so that both surfaces are contiguous to ground plane 66. Further, surfaces 68, 70, 72, 74 and 76 of base 16 mate with the corresponding surfaces of package 12. Opening 18 is also defined by endwall 78 in a general position corresponding to diagonal endwall 50 of mounting block 36. Endwall 78 may be, if desired, parallel to diagonal wall 50 and spaced therefrom with sufficient clearance for assembly.

In accordance with the present invention, a force is applied at an acute angle relative to surface 50, suitably by a torqued screw 80 passing horizontally through endwall 78 of base 16, abutting diagonal surface 50. End 81 of screw 80 is suitably shaped to provide a relatively low friction contact with surface 50.

Further, the metal for screw 80 is preferably of lesser relative hardness than the metal used to form block 36 to prevent screw 80 from gouging the surface 50, restricting vertical movement of package 12 and thus making inoperative the adjustment to be described.

In addition, a clamp or cap 90, formed of an insulative material, and having a recess 92, may be mounted over aperture 61 in the microstrip circuit 14. Clamp 90 is suitably secured as by screws 94 and 96 passing through insulative substrate 64 and ground plane 66 into base 16. Recess 92 is of the same general shape as and in substantial alignment with aperture 61 of microstrip circuit 14. The material of clamp 90 is chosen to have a low dielectric constant, relatively close to the dielectric constant of air, and recess 92 is of such a depth as to insure clamp 90 makes no substantial interference with the electric field of diode 10.

In connecting diode 10 into microstrip circuit 14 as previously noted, package 12 is fit into opening 18 in base 16, with diode 10 being admitted into aperture 61 of microstrip circuit 14. Screw 80 is torqued against angled wall 50, thereby producing both vertical (82) and horizontal (84) components of the force on package 12, as illustrated in the vector diagram in FIG. 2.

The vertical and horizontal components referred to herein, it will be understood and appreciated are terms of convenience, referring to the major axes of the package. The vertical component of the force operates to force surfaces 44 and 48 of mounting block 36 into intimate electrical and thermal contact with surfaces 70 and 76 of base 16. It is noted that when aperture 61 in microstrip circuit 14 is smaller than surface 24 of pedestal 22, overlapping portions of surface 24 will abut and provide electrical contact with the overlapping portions of ground plane 66. It should be further noted, that the vertical component 82 of the force, as previously explained, is inefective to eliminate gaps between the endwalls of package 12 and base 16. Such gaps are substantially reduced if not eliminated, in accordance with the present invention, by providing the horizontal component 84 of the force on package 12 in addition to the force 82. The horizontal component 84 of the force caused by the pressure of screw 80 on diagonal wall 50 forces endwall 46 of mounting block 36 and endwall 26 of pedestal 22 into intimate thermal and electrical contact with the corresponding surfaces of the block 16. Screw 80 is capable alone, it will be appreciated, of securing package 12 to base 16. However, package 12 may additionally be secured by screws 58 and 60 through flanges 40*a* and 40*c* into base 16, noting that torqueing screws 58 and 60 create additional vertical components of force on package 12. Accordingly, the adjustment of screw 80 to provide the proper adjustment of the vertical and horizontal force required is made prior to fastening screws 58 and 60.

Further, although the embodiment described provides for only a single force adjusting screw member 80 positioned to be substantially centered, two screws in the alternative may be positioned in a symmetrical relation about the center line of the package to improve the distribution of the adjustment forces required.

Clamp 90 serves to ensure that the vertical components 82 of the force on package 12 does not cause ground plane 66 to separate from contiguous contact with base 16 Moreover, clamp 90 also serves to maintain proper electrical contact between foil 67 and stripline 62. As noted above, the low dielectric constant of clamp 90 and recess 92 prevents clamp 90 from interfering with the operation of diode 10 and microstrip circuit 14.

It will be appreciated that package 12, may be formed such that angle 51 is equal to 90°, and, further, screws 58 and 60 being relied upon to provide vertical component 52 of the force on package 12. However, in the securing and adjustment of package 12 within opening 18, alternating increments of horizontal and vertical force would be required to be applied to package 12, i.e. screw 80 and screws 58 and 60 would be alternatively torqued, to ensure that package 12 is not prematurely precluded from vertical and horizontal movement by one component of the force.

It will also be appreciated, that package 12 may be formed such that angle 51 is equal to 90° and screw 80 be passed through base 16 at such an angle to impart both vertical and horizontal components of force on package 12. Such an arrangement is schematically illustrated in FIG. 3. It should be noted, however, that such an embodiment requires more complex machining techniques than does the first described embodiment.

It should be appreciated from the foregoing description of the preferred embodiment that the present invention provides for a particularly advantageous method and apparatus for mounting a device in a microstrip circuit wherein good electrical and thermal contact between the package and the base are maintained, thereby substantially reducing parasitic capacitance and inductance and substantially increasing the bandwidth, and RF power output of microstrip circuits, by applying a force having both vertical and horizontal components to the package. In the preferred embodiment such a force is generated by applying a force in a horizontal direction against a side of the package formed at an angle less than 90° from the horizontal.

It will be understood that the above description is illustrative of embodiments of the present invention and that the invention is not limited to specific form shown. Modifications may be made in a design and arrangement of the elements without departing from the spirit of the invention as will be apparent to those skilled in the art.

What is claimed is:

1. An apparatus for mounting a device in a stripline circuit of the type having a dielectric substrate with a ground plane conductor on one face of the substrate and a narrow strip-like conductor on the opposite face of the substrate, said circuit having an aperture for receiving said device in a position to allow for electrical connections to said strip-like conductor, comprising:

a. a first block of electrically and thermally conductive material mounted in contiguous relation with said ground plane to provide an electrical ground to said circuit and to conduct heat from said circuit, said first block having an opening for receiving a second block, said opening being aligned with said aperture and defined by a plurality of surfaces formed in said first block, b. said second block being formed of electrically and thermally conductive material and including a surface portion for mounting said device, and further including a plurality of additional surfaces adapted to mate substantially with the surfaces of said opening, said device being mounted on said surface portion of said second block and having one terminal of said device being electrically and thermally connected to said second block mounting surface portion, c. means for forcing said second block into close mating relation with said first block whereby said mating surfaces of said second block are pressed into good thermal and electrical contact with the corresponding surfaces of said opening in said first block, d. said forcing means including an adjustable force producing member adapted to apply a force to one surface of said second block to adjustably force said second block into said first block along two major axes of the respective blocks, the angle of said force relative to said one surface being an acute angle.

2. An apparatus according to claim 1 wherein said one surface of said second block is inclined relative to said ground plane so as to generate said adjustable force.

3. An apparatus according to claim 1 wherein said one surface of second block is normal to said ground plane and said adjustable force producing member is positioned at an acute angle relative to said one surface.

4. An apparatus according to claim 1 further including:

a third block, formed of an insulative material having a dielectric constant substantially equal to the dielectric constant of air, mounted over said aperture in said stripline circuit and fastened through said dielectric substrate to said first block, to force said ground plane into contiguous contact with said first block in the vicinity of said aperture, said third block having a recess positioned over said aperture, said recess being shaped to avoid substantial interference by said third block with the electric field of said device.

5. An apparatus according to claim 1 wherein said member is formed of a material having a hardness less than the hardness of the material of said second block.

* * * * *